US005931457A

United States Patent [19]

Todoki

[11] Patent Number: 5,931,457

[45] Date of Patent: Aug. 3, 1999

[54] CONVEYER BELT AND SHEET-MATERIAL CONVEYING MECHANISM USING THE BELT

[75] Inventor: Kenji Todoki, Wakayama, Japan

[73] Assignee: Noritsu Koki Co., Ltd., Wakayama, Japan

[21] Appl. No.: 08/878,875

[22] Filed: Jun. 19, 1997

[30] Foreign Application Priority Data

Jun. 26, 1996 [JP] Japan ..... 8-165597

[51] Int. Cl.[6] ..... B65H 29/00

[52] U.S. Cl. ..... 271/184; 271/275; 271/198; 198/688.1; 198/699.1

[58] Field of Search ..... 198/688.1, 699.1; 271/184, 198, 225, 275

[56] References Cited

U.S. PATENT DOCUMENTS 3,661,245 5/1972 Mol et al. ..... 198/699.1 X
4,901,842 2/1990 Lemboke et al. ..... 198/688.1 X

FOREIGN PATENT DOCUMENTS 288743 12/1991 Japan ..... 271/198
139565 6/1993 Japan ..... 271/198
183591 7/1994 Japan ..... 271/198

OTHER PUBLICATIONS

Patent Abstract of Japan vol. 016, No. 457 (P–1426), Sep. 22, 1992 & JP 04 161965 A (RICOH Co. Ltd.), Jun. 5, 1992.

Patent Abstract of Japan vol. 095, No. 004, May 31, 1995 & JP 07 017653 A (Nisca Corp.), Jan. 20, 1995.

*Primary Examiner*—Boris Milef
*Attorney, Agent, or Firm*—Fulbright & Jaworski, LLP

[57] ABSTRACT

A conveyer belt includes a conveying face which is divided into at least two areas one of which has a larger coefficient of friction than the other. Alternatively, the conveying face includes an area in which a coefficient of friction thereof varies from a large value to a small value from one side to the other side along a direction transverse to the belt. A transfer device is provided for discharging sheet material on to the conveying face of the conveyer belt in the direction transverse to the belt. The conveyer belt is disposed in such a manner that the area of the conveying face on the side of the transfer device has a larger coefficient of friction than the area on the other side.

3 Claims, 5 Drawing Sheets

CONVEYER BELT AND SHEET-MATERIAL CONVEYING MECHANISM USING THE BELT

BACKGROUND OF THE INVENTION

1. Filed of the Invention

The present invention relates to a conveyer belt for conveying sheet material such as cut paper sheet mounted thereon, and relates also to a sheet-material conveying mechanism including a belt conveying device using the conveyer belt and a transfer device for discharging the sheet material such as photosensitive material on to a conveying face of the belt in a direction transverse to the belt.

2. Description of the Related Art

A conveyer belt employed in a conveying line of a photographic processing system for conveying photosensitive material includes a flat conveying face having a uniform coefficient of friction over the entire surface thereof. In general, the print paper is conveyed while being pinched between the conveyer belt and press rollers disposed in opposition to the belt by a disposing pitch which is shorter than the length of the conveyed object, i.e. the print paper. Thus, in order to allow the print paper to be conveyed without slipping displacement, it is necessary that the entire conveying face of the belt have a uniform coefficient of friction. If a larger coefficient of friction is obtained by means of e.g. an adhesive layer so as to retain the print paper more reliably on the conveying face, this will cause a problem in a discharging operation of the print paper off the conveying face. For this reason, conventionally, there has been taken no specific measure for increasing the friction coefficient of the conveying face of the belt.

A photosensitive-material conveying mechanism to be incorporated at a final stage of the conveying line of the photographic processing system functions to feed a finished print paper to a sorter conveyer, and includes a belt conveyer device connected with the sorter conveyer and a transfer device for discharging the photosensitive material on to the conveying face of the conveyer belt in a direction transverse to the belt. The transfer device is connected with the conveying line and functions to discharge or drop print papers as conveyed on the conveying line one after another on to the conveying face of the belt conveying device. Then, each dropped print paper is conveyed on the belt in a direction perpendicular to the conveying or discharging direction of the transfer device.

Accordingly, in this belt conveying device, the press rollers cannot be disposed in the area where the print papers are dropped from the transfer device, hence, at least within this particular area, the print paper is conveyed as being just placed on the conveyer belt without being pinched between the belt and the press rollers.

With improvement of performance of the photographic processing system, the conveying speed of the belt conveyer device too has been increasing. Further, when the print paper is dropped on the conveying face, the print paper is warped upwardly. Thus, the paper contacts the conveying face for a very limited area. In addition, as the paper is conveyed on the conveying face, the paper is subjected to an upward lift due to air coming under it. For these reasons, the paper tends to slip or be displaced or more typically, pivoted on the conveying face. Especially, if the print paper is pivoted in such a manner that its leading end is oriented toward the transfer device, the leading end of the print paper may accidentally come into contact with an obstacle such as a roller of the transfer device, then, the print paper will be displaced or even turned over in the worst possible case.

SUMMARY OF THE INVENTION

In view of the above-described state of the art, a primary object of the present invention is to provide a conveyer belt capable of restricting erroneous displacement of the object conveyed thereon, in particular, its critical displacement toward the transfer device and to provide also a sheet-material conveying mechanism using the belt.

For accomplishing the above-noted object, a conveyer belt, according to the present invention, comprises a conveying face provided on a surface thereof, which face is divided into at least two areas, one of the areas having a larger coefficient of friction than the other. With this, through appropriate combination of two areas, i.e. one having a large coefficient of friction and the other having a small coefficient of friction, the erroneous slipping displacement of the conveyed object, e.g. print paper, on the conveying face in a predetermined direction may be effectively restricted. Specifically, in case the conveyed object comprises a sheet-like object, the condition of this object, as being conveyed, becomes very unstable due to the inertia of the object per se at the start of or during the conveying operation and/or the air coming under the object, so that the object is apt to be displaced in a direction where the object can more easily move, i.e. direction of smaller coefficient of friction. Then, taking advantage of this phenomenon, according to the sprit of the present invention, the conveying face of the conveyer belt is provided with areas of different coefficients of friction in such a manner that displacement of the conveyed object in a direction to cause its leading end to be interfered with an obstacle may be restricted in comparison with displacement in other directions.

With understanding of the above-described essential spirit of the present invention, it will be also expected that substantially same function and effect can be achieved alternatively by forming, in the conveying face of the conveying belt, an area within which the coefficient of friction varies from a large value to a small value. In particular, if the friction coefficient is adjusted by a degree of exposure of short fibers from a surface of rubber composition material or by varying and adjusting drying conditions of coating agent, such as urethane resin, applied on a core of the belt, this method of continuously varying the friction coefficient will be easier to implement than the foregoing method of forming separate areas.

In case the art of the present invention is applied in a sheet-material conveying mechanism including a transfer device for discharging the sheet material, e.g. photosensitive material, on to the conveying face of the conveyer belt in a direction transverse to the belt, the belt conveying device is disposed in such a manner that the area of the conveying face of the belt on the side of the transfer device has a larger coefficient of friction than the area on the opposite side. For instance, in the case of photosensitive material such as print paper, the shrinkage rate of emulsion portion of the print paper is greater than that of the base portion thereof. Then, the print paper, when discharged from the transfer device after being dried, will be warped in the conveying direction with a center of curvature being located above the conveying face. Accordingly, the paper tends to be displaced not only by the effect of its inertia at the start of the conveying operation, but also by the effect of air resistance that the paper is subjected to during the conveying operation. However, as the area of the conveying face on the side of the transfer device is provided with a large coefficient of friction, the pivotal displacement of the paper will occur more likely in the direction to bring its rear edge on the side of the transfer device closer to this device. When the pivotal displacement occurs in such manner, contact, when it occurs, between a projecting portion of the sheet material and an obstacle will 'correct' this displacement. On the other hand, if the pivotal displacement occurred in the opposite direction, i.e. the direction to bring the leading edge of the material on the side of the transfer device closer to this device, such contact will increase or aggravate the displacement, so that a critical trouble may occur consequently. In summary, according to the sheet-material conveying mechanism of the invention having the above-described construction, by disposing the belt conveying such that the area of the conveying face of the belt on the side of the transfer device has a larger coefficient of friction than the other area, occurrence of the critical displacement may be effectively restricted.

According to one preferred embodiment of the present invention, the area having a large friction coefficient is formed endless on one side of the belt. With this, the sheet-material conveying mechanism capable of restricting the critical displacement may be realized without modifying its basic conventional construction.

Further and other features and advantages of the invention will become more apparent from the following detailed description of the invention with reference to the accompanying drawings.

DESCRIPTION OF THE PREFERRED EMBODIMENTS

Figure 1:
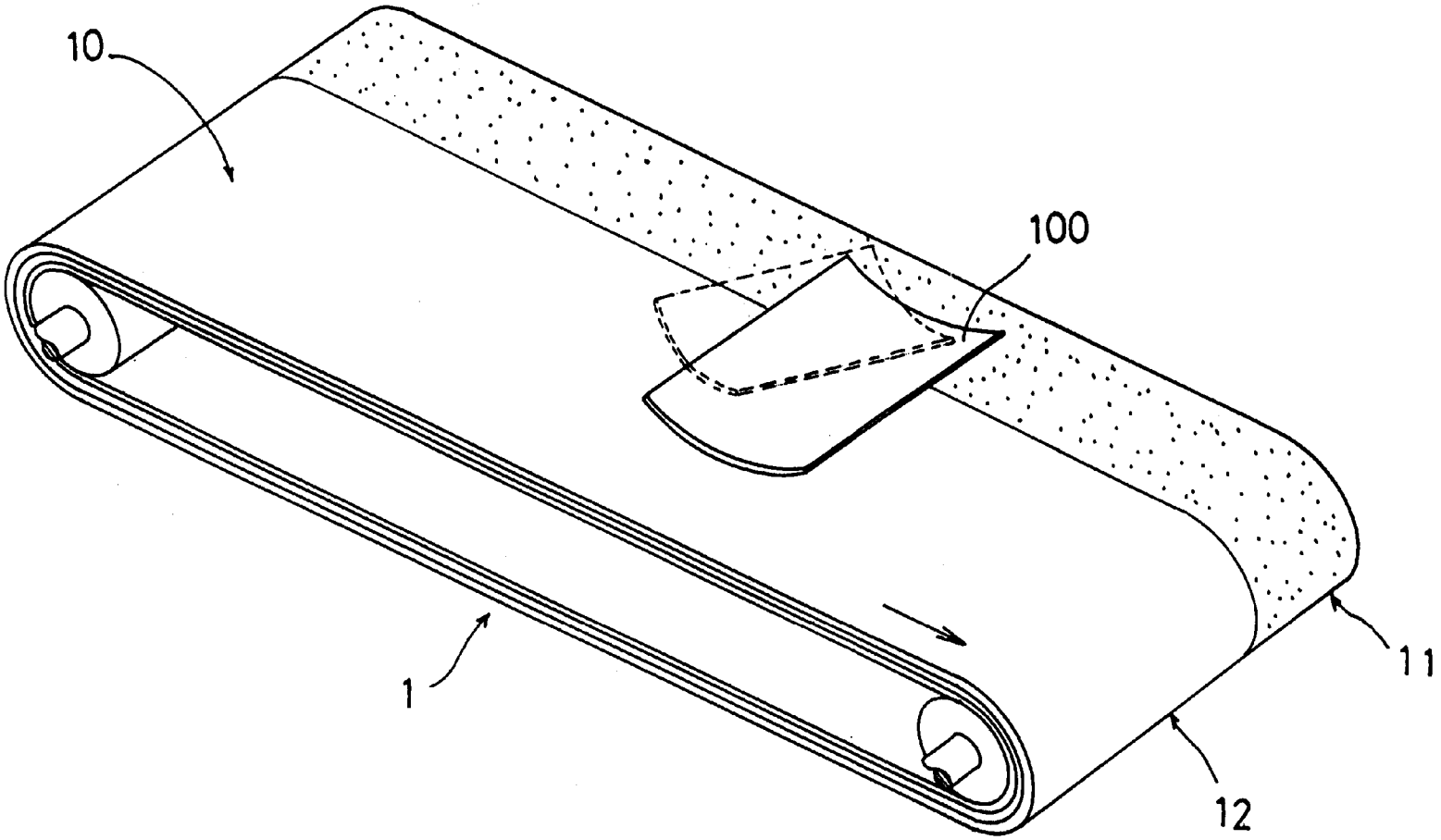
FIG. 1 is a perspective view showing a conveyer belt according to one preferred embodiment of the present invention.

FIG. 1 shows a conveyer belt 1, according to the invention, including a conveyer face 10 on a surface thereof. The conveying face 10 is substantially flat and is divided, along the longitudinal direction of the belt, into a first area 11 and a second area 12. The first area 11 has a larger coefficient of friction than the second area 12. That is to say, a conveyed object 100 mounted on the conveying face 10 is subjected to the larger coefficient of friction at the first area 11 than at the second area 12.

Figure 2:
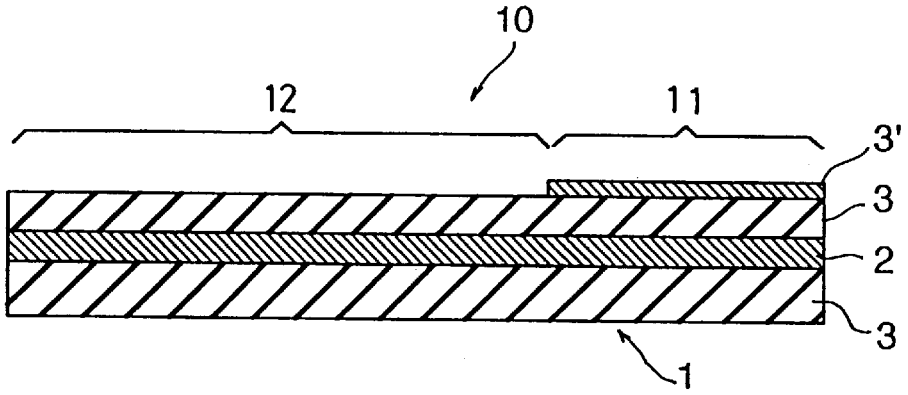
FIG. 2 is a schematic section showing the conveyer belt according to the embodiment.

The conveying belt 1 having the above-described construction may be realized by various conventional methods. For instance, in the case of a construction shown in FIG. 2, a core body 2 is formed by forming plastic material endless by means of fabric or bonding and then rubber material 3 is coated on front and back surfaces of the core body 2. Further, on only one side portion of the front face of the coated layer, there is further formed a high-friction coating layer made of e.g. urethane having a large coefficient of friction, thus forming the first area 11, with the remaining area forming the second area 12.

Figure 3:
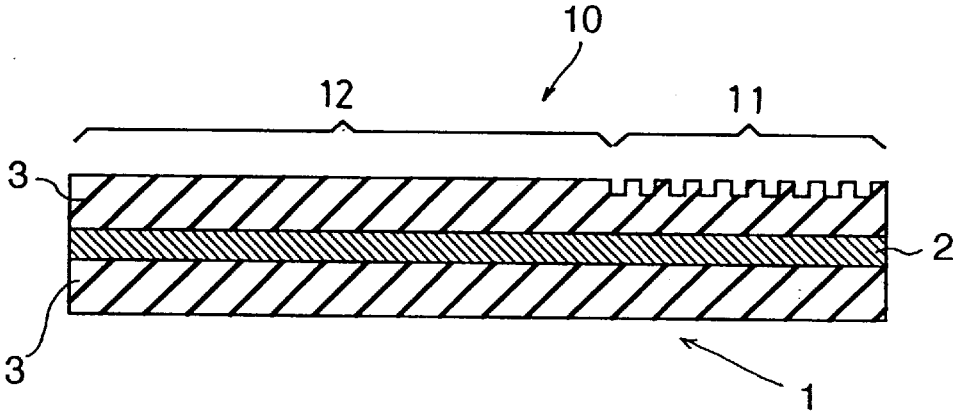
FIG. 3 is a schematic section showing a construction of a conveyer belt according to a further embodiment.

Alternatively, as shown in FIG. 3, the rubber material 3 is coated on the front and back surfaces of the core body 2 of the above-described construction. Then, in one side portion alone of the front face of the coating layer forming the conveying face 10, endless unevenness is formed by using a heating marking instrument having a mat finish, so as to form the first area 11 having the larger coefficient of friction.

Figure 4:
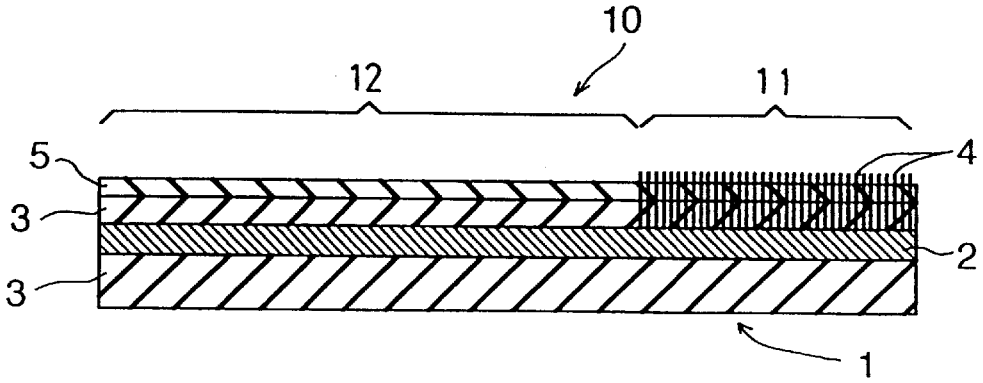
FIG. 4 is a schematic section showing a construction of a conveyer belt according to a still further embodiment.

Still alternatively, as shown in FIG. 4, in only one side portion of the front face of the rubber material 3 in which the core body 2 is embedded, vulcanized rubber composition material 5 added with short fiber 4 is provided, while the other side portion is provided with the vulcanized rubber composition material 5 alone. In studying the behavior of the object on the conveyer belt 1 including the conveying face 10 divided into the first and second areas 11, 12 having the different coefficients of friction each other, in case the object 100 comprises a dried print paper for instance, it has been demonstrated that an emulsion portion of this print paper 100 has a greater drying shrinkage rate than a base portion thereof, so that the dried print paper 100 discharged on to the conveyer belt 1 is warped in the conveying direction with a center of curvature being located above the conveyer belt, as illustrated in FIG. 1. Then, as this print paper 100 is conveyed, a force is applied to the print paper 100 to tend to slide it on the conveying face 10, due to inertia of the paper per se at the start of the conveying operation and/or air resistance that the paper receives during the conveying operation. In the course of this, as one side of the print paper 100 is placed on the first area 11 having the large friction coefficient while the other side thereof is placed on the second area 12 having the small friction coefficient, the print paper 10 will be very likely to pivot clockwise as denoted with dot lines in FIG. 1. Therefore, with the above-described construction, it is possible to positively limit the direction of such possible pivotal displacement.

Figure 5:
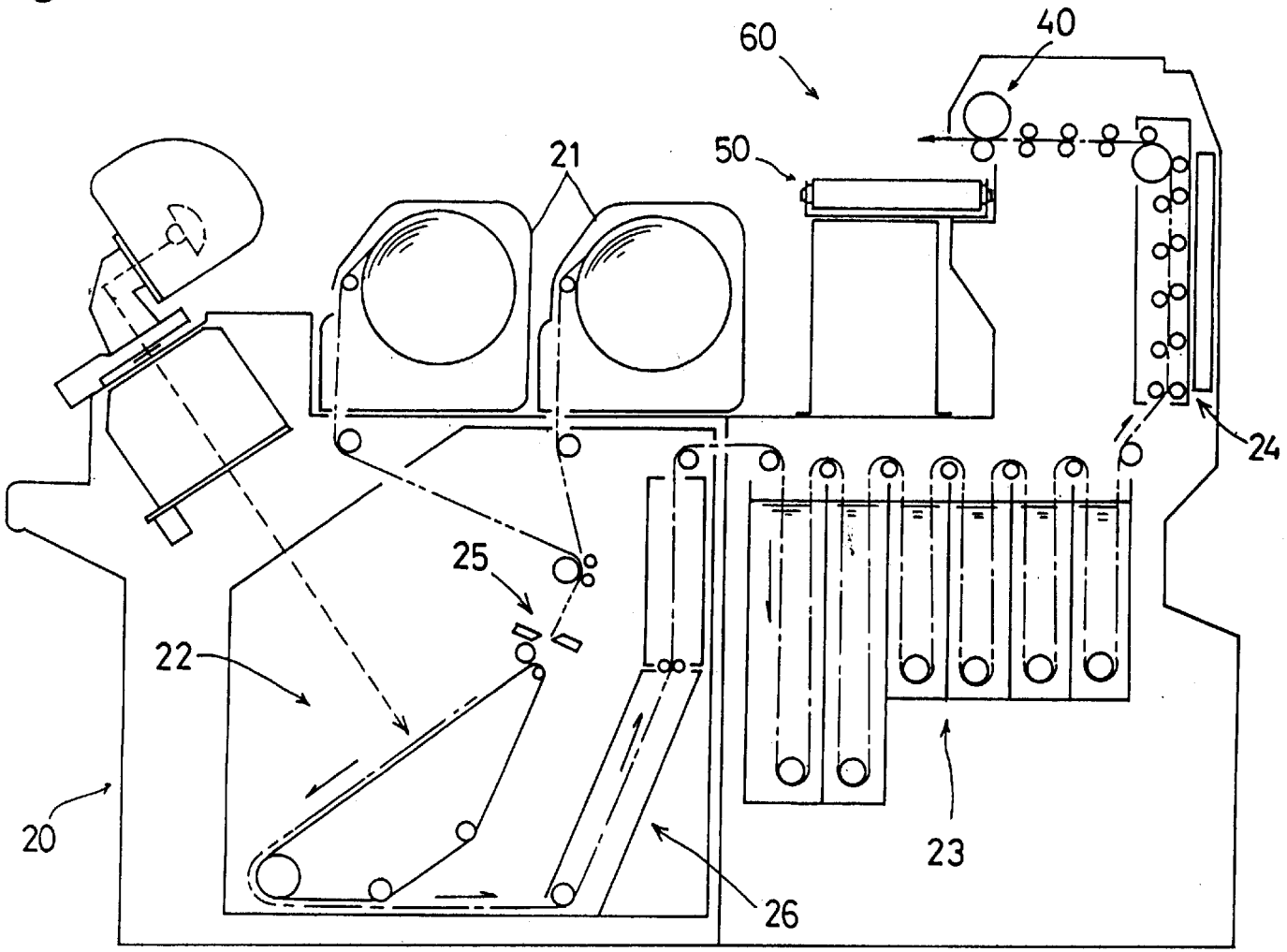
FIG. 5 is a view showing a schematic construction of a photographic processing system using a photosensitive-material conveying mechanism according to the present invention.

FIG. 5 shows a photographic processing system 20 for carrying out printing and developing operations. This photographic processing system 20 includes paper magazines 21 for storing a print paper roll, an example of the photosensitive material, in a rolled state, a printing/exposing section 22, a developing section 23, a drying section 24, and a conveying line 26 for cutting the print paper roll drawn out of each paper magazine 21 by means of a cutter 25 and then conveying the cut paper through the respective processing sections described above. As shown more particularly in FIG. 6, for feeding the finished print paper 100 to a vertically movable sorter conveyer for sorting the finished papers 100 according to each customer's order, there is also provided a conveying mechanism 60 consisting essentially of a transfer device 40 and a belt conveying device 60 which are incorporated within the final stage of the conveying line 26. This belt conveying device 50 employs the above-described conveyer belt 1 according to the present invention. The transfer device 40 is adapted to discharge the print papers 100 on to the conveying face 10 of the conveyer belt 1 in a direction transverse to this conveyer belt 1. Also, the conveyer belt 1 of the belt conveying device 50 is entrained about a drive pulley 51 and a driven pulley 52 in such a manner that its first area 11 having the large friction coefficient is disposed on the side adjacent the transfer device 40.

In this photographic processing system 20, the print papers 100 printed and exposed are arranged into a three-line, staggered zigzag pattern, by means of an unillustrated sieving device and the papers 100 as arranged in this pattern are then conveyed through the developing section 23 and the drying section 24 to the transfer device 40.

Figure 6:
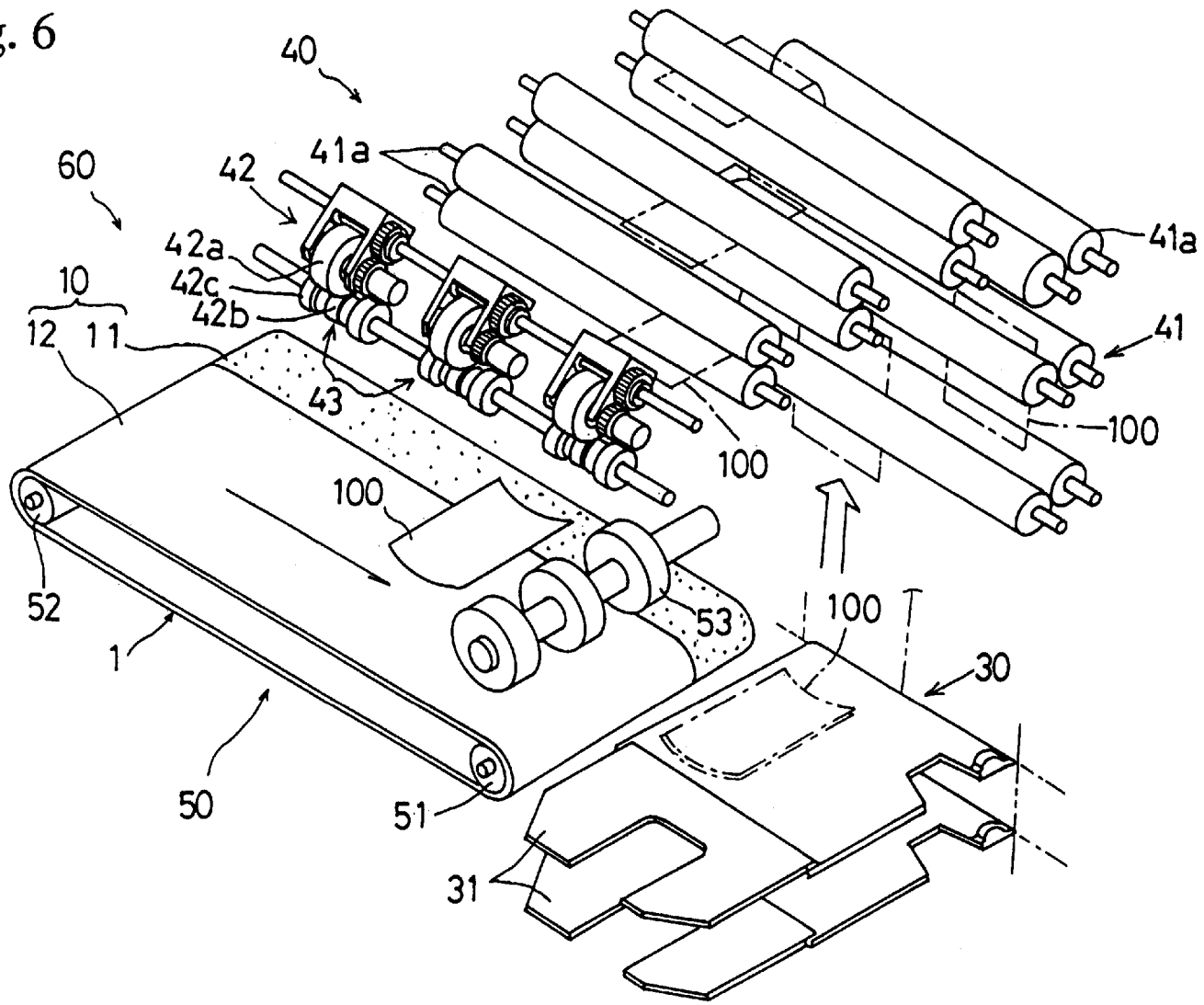
FIG. 6 is a perspective view of the photosensitive-material conveying mechanism.
Figure 7:
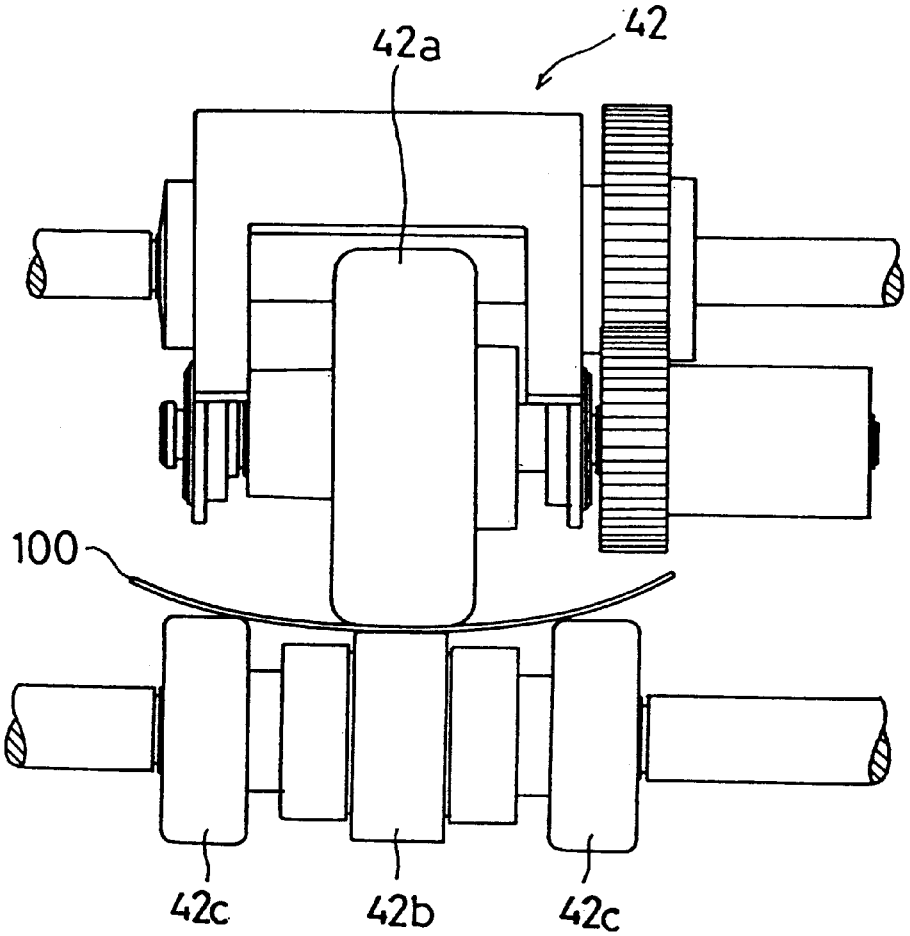
FIG. 7 is an enlarged view showing vicinity of a discharging pinch roller mechanism incorporated in the photosensitive-material conveying mechanism.

The transfer device 40, as shown in FIG. 6, includes a transport pinch roller mechanism 41 having a plurality of rollers 41*a* and a discharge pinch roller mechanism 42 having large drive rollers 42*a* and small driven rollers 42*b* placed in contact with the drive rollers 42*a* to be driven together. The drive rollers 42*a* are driven to rotate by a common drive shaft via a gear transmission mechanism. Also, as may be apparent from FIG. 7, on a same shaft as and coaxially with the receiver rollers 42*b* , a plurality of guide rollers 42*c* are mounted in such a manner as to bind the receiver rollers 42*b* therebetween. With this construction, opposed longitudinal side edges of each print paper 100 are slightly bent upwards, and this paper in a trough-like form is discharged on to the conveying belt 1 of the belt conveying device 50. Accordingly, with its longitudinal stiffness increased by the trough-like cross section, it is possible to prevent such an accident that a leading end of the print paper will sag and come into contact with the conveying belt 1 or a preceding print paper 100, resulting in irregularity in the mounted condition of the print paper 100 on the conveying belt 1.

As shown in FIG. 6, the belt conveying device 1 is disposed below a discharge exit 43 of the transfer device 40, with the conveying direction of the transfer device 40 extending perpendicular to the conveying direction of the belt conveying device 50. The conveyer belt 1 is driven intermittently in association with receipt of the print paper 100 from the transfer device 40. Further, adjacent the downstream end of the conveyer belt 1 where the belt 1 is connected with the sorter conveyer 30, press rollers 53 are provided.

The sorter conveyer 30 includes a plurality of receiver plates 31 on each of which one order number of print papers 100 are stacked. These receiver plates 31 are attached to a vertically movable unillustrated endless belt to be oriented substantially horizontal at the connecting portion with the conveyer belt 1.

With the above-described belt conveying device 50, as described hereinbefore with reference to FIG. 1, each print paper 100 mounted on the conveyer belt 1, even if displaced thereon, will pivot in such predetermined manner that the rear edge portion thereof on the side of the transfer device 40 relative to the conveying direction may approach this transfer device 40. Then, even if the projecting edge portion of the paper may come into contact with e.g. the guide roller 42*b* or the driven roller 42*b* , this contact will correct this pivotal displacement to bring the paper back into the proper posture. Accordingly, it is possible to prevent unexpected and inconvenient pivotal displacement of the print paper 100 or more serious accident of complete fall of the paper off the belt 1.

In the foregoing embodiment, in the conveying face 10 of the conveyer belt 1 includes the two areas, i.e. the first area 11 and second area 12 having different friction coefficients. Instead, it is also possible to further provide, on the side opposite from the first area 11 across the second area 12, a third area having a coefficient of friction which is smaller than that of the first area 11 but greater than that of the second area 12. With this, it is possible to prevent the print paper 100 discharged from the transfer device 40 from falling off the conveying belt 1 due to the discharging momentum.

Alternatively, it is also possible to provide the conveying face 10 with an area in which its friction coefficient varies from a large value to a small value from one side to the other side along the transverse direction of the belt. Further alternatively, the distribution pattern of the unevenness formed on the surface may be varied or the area of the short fiber exposed on the surface may be varied. Further, different urethane materials having different coefficients of friction may be applied separately on the surface. In short, what is essential for the present invention is that one side portion of the conveying face of the belt have a larger coefficient of friction than the other portion thereof. Therefore, various modifications within this spirit will be all encompassed within the scope of the invention.

In the foregoing embodiment, photosensitive material, such as print paper, is employed as a conveyed object. Needless to say, the present invention may be applied to conveyance of any other kind of sheet material.

The invention may be embodied in other specific forms without departing from the spirit or essential characteristics thereof The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. A sheet material conveying mechanism comprising:

a belt conveying device including:

a conveyer belt including a conveying face on a surface thereof, the conveying face having a first area extending along a side edge of the belt in a belt-conveying direction and a second area extending centrally of the belt, the first area having a larger coefficient of friction than the second area; and a transfer device for discharging a rectangular sheet material onto the conveying face in a transverse direction of the belt, wherein said belt conveying device and said transfer device are arranged such that the first area of said conveyer belt is positioned adjacent to said transfer device, further wherein said second area has a flat face having a smaller coefficient of friction and said first area has a face having a larger coefficient of friction, the flat face being substantially flush with the face having the larger coefficient of friction.

2. A sheet material conveying mechanism as claimed in claim 1, wherein the face having the larger coefficient of friction comprises an uneven face.

3. A sheet material conveying mechanism as claimed in claim 1, wherein a coefficient of friction varies from a large value to a small value from the first area to the second area.

* * * * *